US005452270A

United States Patent [19]

Ikeda et al.

[11] Patent Number: 5,452,270

[45] Date of Patent: Sep. 19, 1995

[54] MELODY ALARM TIMEPIECE

[75] Inventors: Hidetsugu Ikeda; Makoto Yanaka, both of Tokyo, Japan

[73] Assignee: Seikosha Co., Ltd., Japan

[21] Appl. No.: 846,557

[22] Filed: Mar. 5, 1992

[30] Foreign Application Priority Data

Mar. 6, 1991 [JP] Japan ..... 3-040078

[51] Int. Cl.[6] ..... G04C 21/16

[52] U.S. Cl. ..... 368/273; 368/251; 368/75

[58] Field of Search ..... 368/272, 75, 273, 250–266

[56] References Cited

U.S. PATENT DOCUMENTS

| | | | |
|---|---|---|---|
| 1,096,680 | 5/1914 | Clement | 368/272 |
| 2,641,897 | 6/1953 | Maas | 368/75 |
| 4,104,865 | 8/1978 | Sasaki | 368/28 |
| 4,323,995 | 4/1982 | Chiu | 368/75 |
| 4,349,899 | 9/1982 | Komatsu et al. | 368/75 |
| 4,357,692 | 11/1982 | Broghammer et al. | 368/75 |
| 4,396,297 | 8/1983 | Akahane | 368/262 |
| 4,712,926 | 12/1987 | Tanabe | 368/251 |

OTHER PUBLICATIONS

Patent Abstracts of Japan, vol. 8, No. 6 (P-247) (1443) 12 Jan. 1984 & JP-A-58 169 082 (Matsushita Denko K.K.) 5 Oct. 1983.

*Primary Examiner*—Bernard Roskoski
*Attorney, Agent, or Firm*—Adams & Wilks

[57] ABSTRACT

Melodies are changed over sequentially in accordance with hours at each of which an alarm melody is to be played as a time signal so that predetermined melodies are always played at predetermined hours, respectively. In addition, even if the hours and the melodies become discordant with each other as a result, for example, of the correction of the time made during the timekeeping operation of the timepiece, the melodies are automatically reset at a predetermined time so as to be coincident with the corresponding hours.

A switch S2 for detecting a correct hour is on-off controlled by a cam 6a provided as an integral part of a minute pipe 6 that makes one revolution per hour. A reset switch S3 is on-off controlled through a reset lever 5 pivoted by an hour wheel 4 that makes one revolution per twelve hours. An alarm control circuit in an IC 3 incorporates a plurality of melodies. In response to a correct hour signal supplied thereto, the alarm control circuit outputs the incorporated melodies sequentially and plays each melody through a speaker. When supplied with a reset signal, the alarm control circuit makes the alarm melody which is to be output next coincident with the first melody.

9 Claims, 4 Drawing Sheets

MELODY ALARM TIMEPIECE

BACKGROUND OF THE INVENTION

The present invention relates to a melody alarm timepiece.

There are known been alarm timepieces designed to sound an alarm in the form of a melody. For example, Japanese Utility Model Post-Exam Publication No. 63-13513 discloses an alarm timepiece designed so that the user can preselect one of a plurality of melodies incorporated therein by pressing a push button. When the alarm set time is reached, the melody selected by the user is played. The alarm timepiece is arranged such that if the user presses the push button during the performance of the selected melody, the next melody is played from the beginning.

The above-described prior art is designed to sound an alarm in the form of a melody and to enable melodies to be changed from one to another if the user presses the push button during the performance of a melody. However, this arrangement cannot be applied to an alarm timepiece that sounds an alarm in the form of a melody and that enables melodies to be changed sequentially in accordance with each hour of the day (e.g., one o'clock, two o'clock, etc. defined herein as "on-the-hour"), at each of which an alarm melody is to be sounded as a time signal.

SUMMARY OF THE INVENTION

It is an object of the present invention to provide a melody alarm timepiece which is designed so that melodies are changed sequentially on-the hour. In accordance with the present invention, an alarm melody is to be sounded as a time signal, and even if the hours and the melodies become discordant with each other as a result, for example, of the correction of the time made during the timekeeping operation of the timepiece, the melodies are automatically reset at a predetermined time, thereby allowing a predetermined melody to be always played on-the-hour and at a corresponding hour of the day at which this melody is to be played as a time signal.

To attain the above-described object, the present invention provides a melody alarm timepiece comprises: a switch for detecting each on-the-hour of the day that is on-off controlled by a cam provided as an integral part of a wheel that makes one revolution per hour. A reset switch is provided that is on-off controlled through a reset lever pivoted by a wheel that makes one revolution per twelve hours. An alarm control circuit is provided incorporating a plurality of melodies, and a sounding device is provided that plays a melody in response to a melody output signal from the alarm control circuit. The alarm control circuit is arranged such that each time an on-the-hour signal that is detected by the on-the-hour detecting switch is supplied to a select terminal, the alarm control circuit outputs the incorporated melodies sequentially, and when a reset signal is supplied to a reset terminal from the reset switch, the alarm control circuit makes the alarm melody which is to be output next coincident with the first melody.

DETAILED DESCRIPTION OF THE INVENTION

Figure 1:
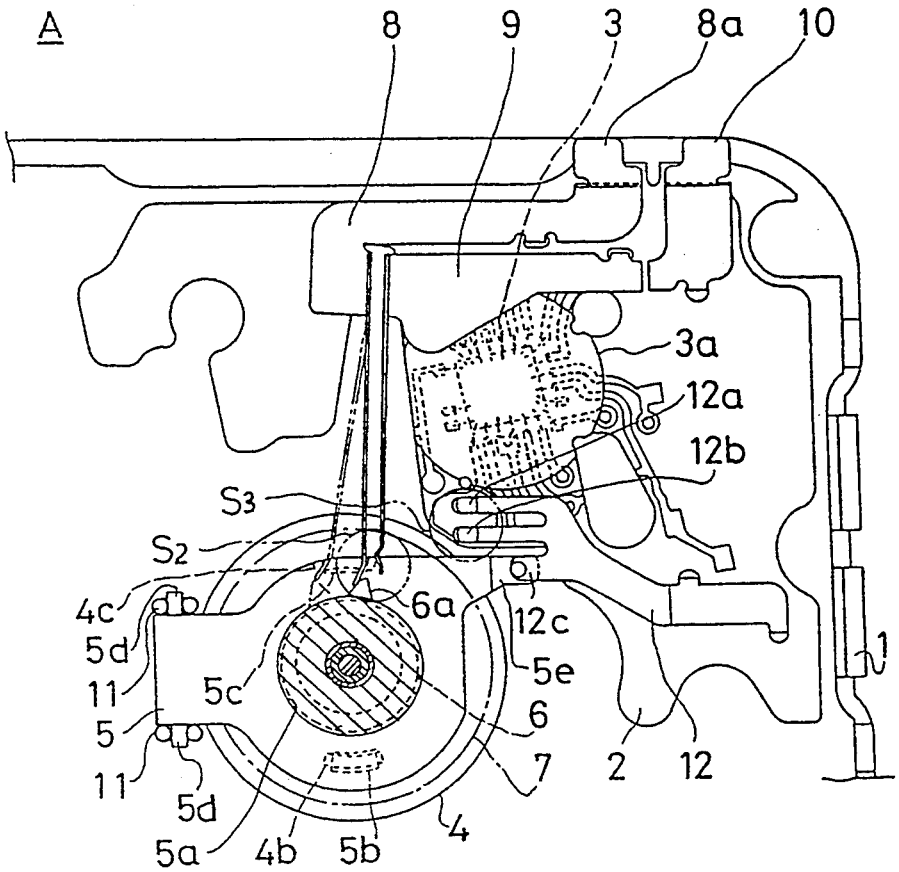
FIG. 1 is a schematic illustration of the inventive timepiece.
Figure 2:
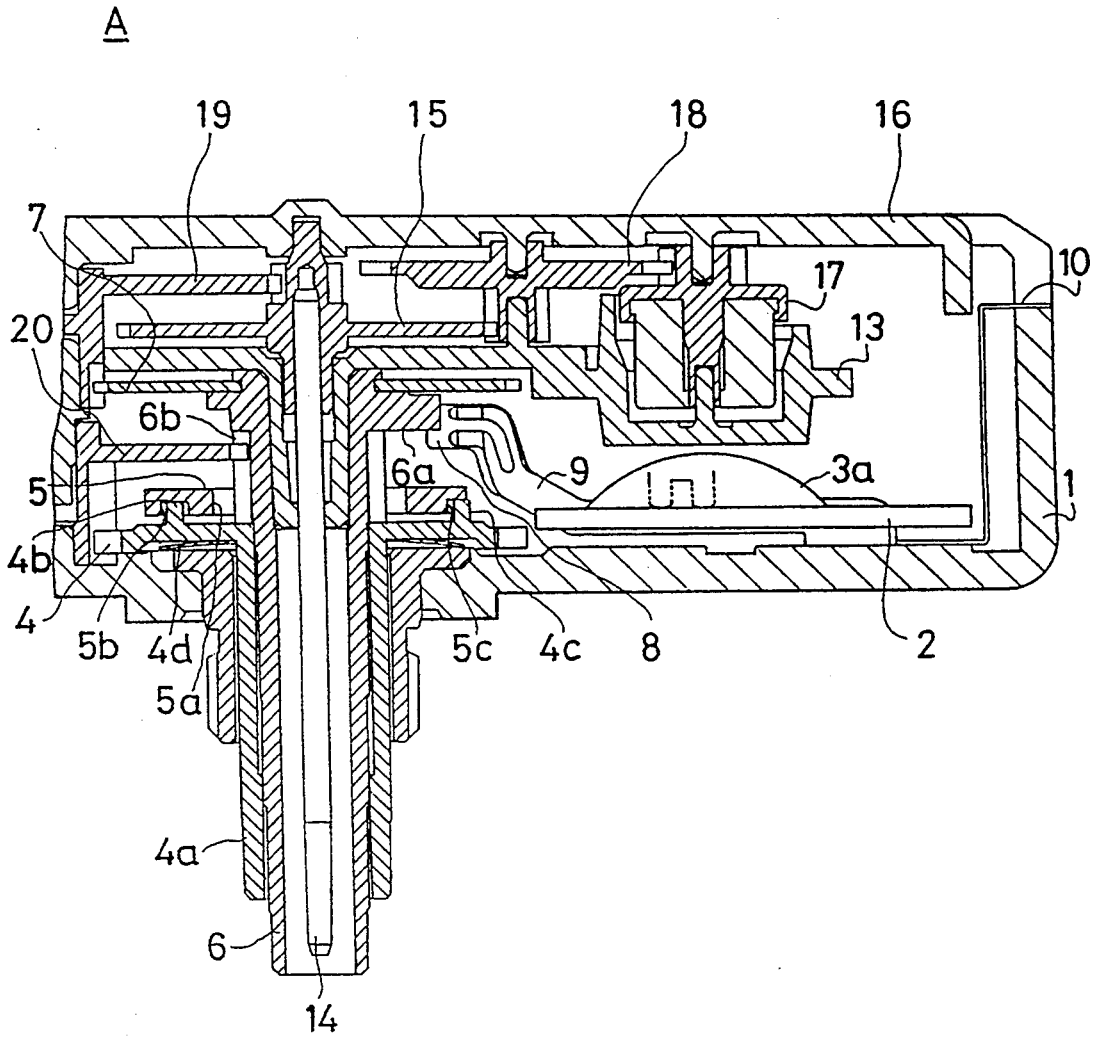
FIG. 2 is an enlarged sectional view of an essential past of the inventive timepiece.

As shown in FIGS. 1 and 2, a printed circuit board 2 is secured inside a lower case 1 of a timepiece movement A. The printed circuit board 2 has wiring patterns formed on the upper side thereof. Circuit elements such as transistors, resistor, condenser, etc. (not shown) are connected to predetermined positions, respectively, of the printed circuit board 2. An integrated circuit (IC) 3 is connected to an approximately central portion of the printed circuit board 2 and covered with a potting resin 3*a*. The IC 3 has a timepiece circuit, for ascertaining the time of the day an alarm control circuit 30 shown in FIG. 4, etc. An hour wheel 4 is rotatably supported on the lower case 1, and a reset lever 5 is located at the upper side of the hour wheel 4. An hour wheel spring 4*d* is interposed between the hour wheel 4 and the lower case 1 to bias the hour wheel 4 toward the reset lever 5.

A minute pipe 6 extends through an hour pipe 4*a* of the hour wheel 4 and a hole 5*a* in the reset lever 5. The inner end portion of the minute pipe 6 is formed with a radially projecting angle minute cam 6*a* and a minute pinion 6*b* as integral parts thereof. In addition, a minute wheel 7 is attached to the inner end portion of the minute pipe 6 through a slip mechanism (not shown).

A pair of contact members 8 and 9 for detecting an on-the-hour time of the day are connected at the proximal portions thereof to predetermined positions, respectively, of the printed circuit board 2. The distal end portion of the contact member 8 extends to a position where it is engageable with the minute cam 6*a*. In a normal state, the distal end portion of the contact member 9 extends to a position where it is separate from the distal end portion of the contact member 8 and hence unable to engage with the minute cam 6*a* but it is within the range of elastic deformation of the contact member 8. Accordingly, when the contact member 8 is deflected to a position represented by the two-dot chain line by being pressed by the minute cam 6*a* at every on-the-hour time of the day and then released to return by virtue of its resilience, the contact member 8 contacts the contact member 9 instantaneously, thus turning on detecting including a switch S2 for detecting an on-the-hour time to generate an on-the-hour signal. The proximal portion of the contact member 8 extends to define an output terminal 8*a*. An output terminal 10 is connected at its proximal portion to a predetermined position of the printed circuit board 2. Both the output terminals 8*a* and 10 are exposed through the lower case 1. An externally provided member, for example, a speaker Sp (shown in FIG. 4), is connected to the output terminals 8*a* and 10.

Figure 3:
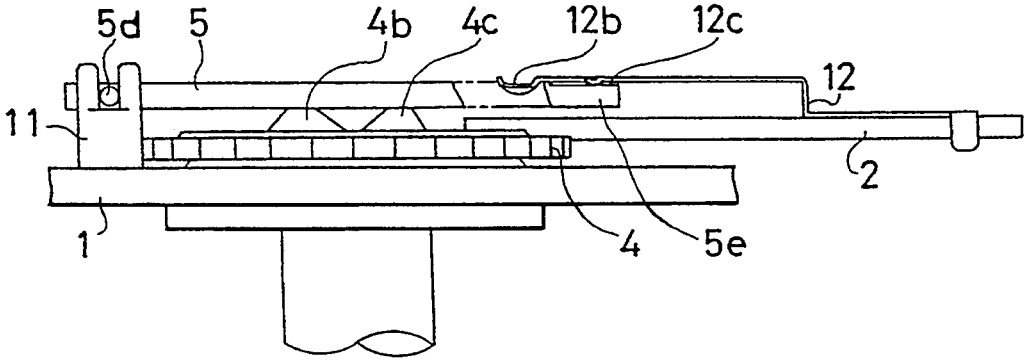
FIG. 3 is an enlarged front view of the essential part.

As shown in FIGS. 1 and 3, the reset lever 5 has a pivot portion 5*d* about which the lever 5 pivots, the pivot portion 5*d* being pivotably supported by a bearing 11 projecting from the lower case 1. An engagement portion 5*e* extends from the reset lever 5. The proximal portion of a reset member 12, which constitutes a reset switch, is connected to a predetermined position of the printed circuit board 2. The distal end portion of the reset member 12 divides into three branches, one of which extends over the engagement portion 5*e* of the reset lever 5 to define an engagement portion 12*c* that biases the engagement portion 5*e* downwardly. The other two branches are defined as movable contacts 12*a* and 12*b* which are capable of resiliently contacting reset switch wiring patterns on the printed circuit board 2.

As shown in FIGS. 1, 2 and 3, as a mechanism for pivoting the reset lever 5, cam pawls 4*b* and 4*c* which define slanting surfaces in the direction of rotation of the hour wheel 4 are provided on the upper side of the hour wheel 4 at respective positions which are 180° spaced apart from each other and which are at different distances from the center. The lower side of the reset lever 5 is provided with cam grooves 5*b* and 5*c* at respective positions where the cam grooves 5*b* and 5*c* are capable of being fitted with the cam pawls 4*b* and 4*c*, respectively. Since the reset lever 5 is subjected to a downward biasing force from the engagement portion 12*c* of the reset member 12, the lower surface of the reset lever 5 is in resilient contact with the upper surfaces of the cam pawls 4*b* and 4*c* of the hour wheel 4. When the hour wheel 4 rotates, the cam pawls 4*b* and 4*c* slide on the lower surface of the reset lever 5 such that the cam pawls 4*b* and 4*c* face the cam grooves 5*b* and 5*c* once a 12-hour period. When the cam pawls 4*b* and 4*c* face the cam grooves 5*b* and 5*c*, they engage are fitted with each other. As a consequence, the reset lever 5 lowers to bring the movable contacts 12*a* and 12*b* of the reset member 12 into contact with the wiring patterns on the printed circuit board 2, thus turning on the reset switch S3 to generate a reset signal. It should be noted that the arrangement is such that when the reset switch S3 is on, the on-the-hour detecting switch S2 does not turn on.

As shown in FIG.2, the minute pipe 6 is rotatably supported by the hour pipe 4*a* and a middle plate 13, and a second wheel 15 is rigidly secured to the inner end portion of a second shaft 14 extending through the minute pipe 6. The second wheel 15 is rotatably supported by the middle plate 13 and an upper case 16. The rotation of a rotor 17 is transmitted to the second wheel 15 through a driving wheel 18, and the rotation of the second wheel 15 is transmitted to the minute wheel 7 through an intermediate wheel 19. The rotation of the minute wheel 7 causes the minute pipe 6 to rotate through the slip mechanism, and the rotation of the minute pinion 6*b* is transmitted to the hour wheel 4 through a transmitting wheel 20.

Figure 4:
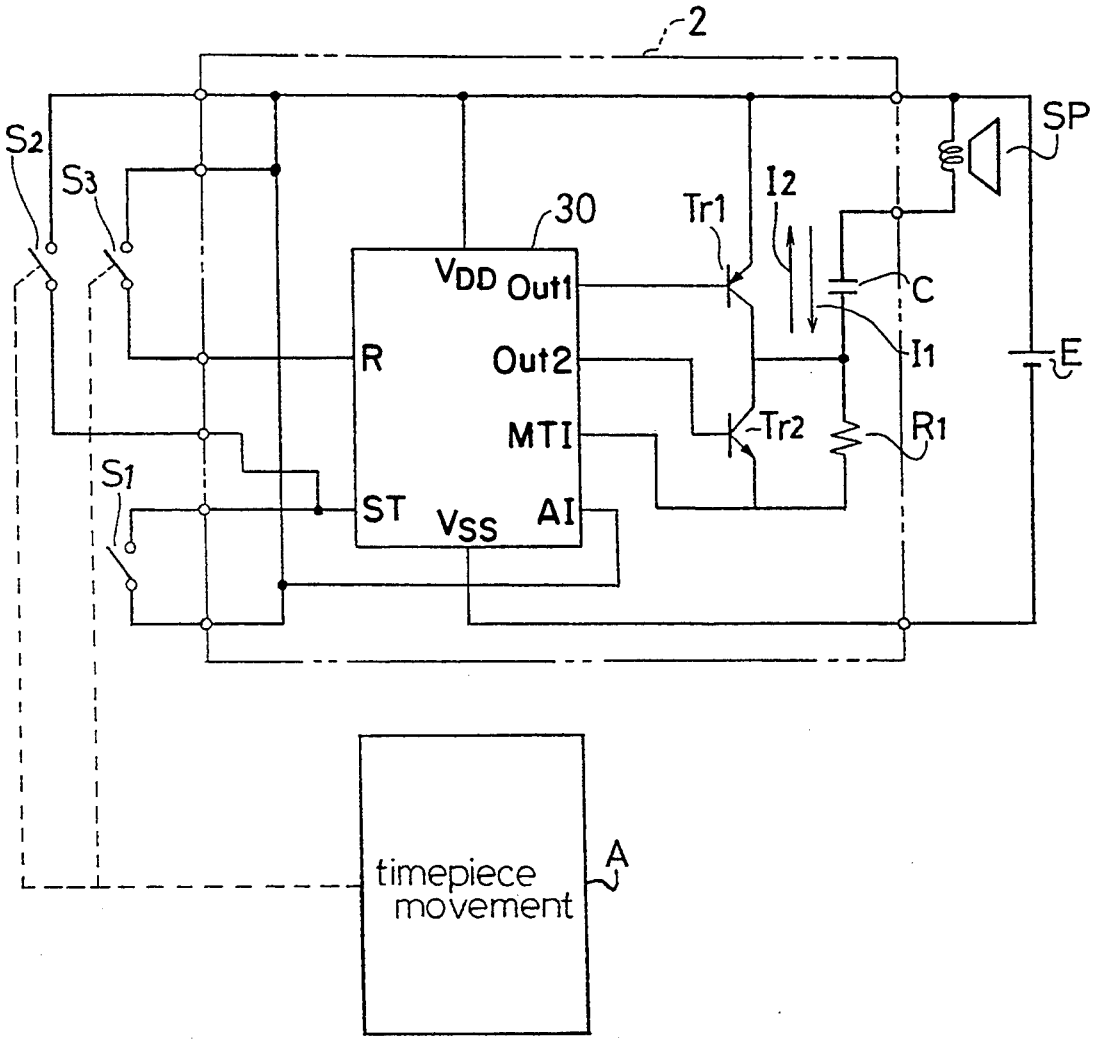
FIG. 4 is a circuit diagram in accordance with the inventive timepiece.

FIG. 4 shows the melody alarm control circuit 30. More specifically, the alarm control circuit 30 that controls the melody alarm is fabricated on the printed circuit board 2. The alarm control circuit 30 is arranged to incorporate, for example, twelve melodies corresponding to twelve different hours, from one o'clock to twelve o'clock, in advance. When supplied with an on-the-hour signal, melody output terminals Out1 and Out2 alternately generate a melody output signal to turn on transistors Tr1 and Tr2 alternately. When the transistor Tr2 is on, an electric current I1 flows in a direction in which a condenser C is charged, whereas, when the transistor Tr1 is on, an electric current I2 flows in a direction in which the condenser C is discharged. The currents I1 and I2 are different in direction from each other. The currents I1 and I2 allow a melody alarm to be generated from the speaker Sp. R1 denotes a resistance of feedback circuit, and MTI an input terminal for feedback. A switch S1, which is a select switch of the program, is connected to a select terminal ST. By manually turning on/off the select switch S1, it is possible to set melodies sequentially, for example, such that the melody of one o'clock is played as a first alarm, and the melody of two o'clock as a second alarm. When an on-the-hour signal is generated from the on-the-hour detecting switch S2 comprising the contact members 8 and 9 provided on the timepiece movement A, described above, this signal is supplied to the select terminal ST to select a melody, and outputs are alternately generated from the output terminals Out1 and Out2. The reset switch S3 comprises the reset lever 5 and the reset member 12 provided on the timepiece movement A. A reset signal generated from the switch S3 is supplied to a reset terminal R to reset the alarm control circuit 30 so that the alarm melody which is to be output next is made coincident with the first melody.

The melody generating operation will be explained. Melodies which are to be played on-the-hour at twelve different hours, from one o'clock to twelve o'clock, are set in advance by actuating the select switch S1, as described above. In FIG. 2, the rotation of the rotor 17 causes the minute pipe 6 to make one revolution per hour and the hour wheel 4 to make one revolution per twelve hours through the above-described timepiece wheel train. The minute cam 6*a* also rotates together with the minute pipe 6, and when the minute hand (not shown) approaches the on-the-hour position, the distal end portion of the contact member 8 engages with the minute cam 6*a*, as shown in FIG. 1. As the minute cam 6*a* rotates, the contact member 8 is pressed so as to be deflected, and when the minute cam 6*a* has passed, the contact member 8 returns by virtue of its resilience, passing the neutral position and instantaneously contacting the distal end portion of the contact member 9, thus causing the on-the-hour detecting switch S2 to be closed to generate an on-the-hour signal, which is supplied to the terminal ST. Thus, the melody corresponding to the hour concerned is selected, and outputs are generated from the melody output terminals Out1 and Out2 and supplied to the speaker Sp to play the melody as an alarm.

When the hour wheel 4 further rotates one revolution and the hour hand (not shown) reaches the approximate position where it indicates half past twelve, (or a time between a first on-the-hour time, twelve o'clock, and a second on-the-hour time, one o'clock) the cam pawls 4*b* and 4*c* fit into the cam grooves 5*b* and 5*c*, so that the reset lever 5 is pivoted by the resilient force from the reset member 12, thus causing the engagement portion 5*e* to lower. As a result, the movable contacts 12*a* and 12*b* come in contact with the fixed contacts on the printed circuit board 2 to close the reset switch S3, generating a reset signal, which is supplied to the reset terminal R. Thus, the alarm control circuit 30 is reset so that the melody which is to be played when the timepiece next reaches the second on-the-hour time one o'clock, is made coincident with the melody set so as to be played at one o'clock. Thus, even when the hours and the melodies become discordant with each other as a result of the correction of the indicating hands made during the timekeeping operation of the timepiece, the melodies are automatically reset to the correct ones at a little past twelve o'clock, so that the right melody is played as an alarm every hour on the hour from the next one o'clock.

Although in this embodiment the IC 30 incorporates twelve melodies, it should be noted that the arrangement may be such that the IC 30 incorporates six melodies and two cam pawls and two cam grooves are provided in symmetry with respect to the central point so that a reset signal is generated twice per twelve hours. It is also possible to arrange the system such that melodies are repeated at a desired interval of time by increasing the number of cam pawls and cam grooves.

As has been described above, the melodies corresponding to each hour at which an alarm melody is to be played as a time signal are automatically changed sequentially by the alarm control circuit. Accordingly, it is possible to provide a timepiece which is pleasant to use and which allows the user to determine the time simply by listening to the melody without looking at the timepiece. In addition, even if the hours and the melodies become discordant with each other as a result, for example, of the correction of the time made during the timekeeping operation of the timepiece, the melodies are automatically reset at a predetermined time, thereby allowing predetermined melodies to be always played at predetermined hours, respectively. Since a melody corresponding to each hour at which a time signal is to be sounded is played by the alarm control circuit provided on the printed circuit board, it is unnecessary to provide a means for detecting alarm information, for example, a code pattern, and the arrangement is therefore simplified.

We claim:

1. A melody alarm timepiece comprising:

a switch for detecting an on-the-hour time corresponding to the beginning of each hour of a day and producing a corresponding on-the-hour signal, the switch being on-off controlled by a cam provided as an integral part of a rotationally driven member that makes one revolution per hour;

a reset switch, the reset switch being on-off controlled through a reset lever pivoted by a rotationally driven member that makes one revolution per twelve hours for producing a reset signal;

an alarm control circuit for electronically storing a plurality of melodies including a first melody and having a select terminal connected to receive the on-the-hour signal and a reset terminal connected to receive the reset signal; and a sounding device for playing a melody in response to a melody output signal from said alarm control circuit;

whereby each time an on-the-hour signal detected by said on-the-hour detecting switch is supplied to the select terminal, said alarm control circuit sequentially outputs one of the electronically stored melodies, and when a reset signal is supplied to the reset terminal from said reset switch, said alarm control circuit is reset so that the next alarm melody output is the first melody so that the sequence of the electronically stored plurality of melodies is electronically reset every twelve hours.

2. A melody alarm timepiece according to claim 1; wherein the reset switch supplies the reset signal at an ascertained time of day between a first and a second on-the-hour time of day; and the alarm control circuit includes means for resetting a melody sequence to generate the first melody signal at the second on-the-hour time and to generate a respective melody of the melody sequence sequentially at each subsequent ascertained on-the-hour time.

3. A melody alarm timepiece according to claim 2; wherein the first and the second on-the-hour times are twelve o'clock and one o'clock respectively.

4. A timepiece, comprising: a timepiece circuit for ascertaining a time of day; detecting means for detecting an on-the-hour time corresponding to the beginning of each hour of a day and producing an on-the-hour signal in response thereto, the detecting means including a switch, a rotationally driven member that makes one revolution per hour and a cam integrally fixed to the rotationally driven member, the switch being on-off controlled by the cam each time the rotationally driven member makes one revolution; resetting means for supplying a reset signal at at least one predetermined ascertained time of day; an alarm control circuit for electronically storing a plurality of different melodies and for generating melody signals corresponding to the respective stored melodies, sequentially from a first melody to a last melody of a melody sequence, the alarm control circuit being responsive to the on-the-hour signal for sequentially generating a different one of the melodies of the melody sequence at each on-the-hour time of the day, and the alarm control circuit being responsive to the reset signal for electronically resetting the melody sequence to the first melody so that the melody sequence is reset at the at least one predetermined ascertained time of day; and means responsive to the melody signals for playing the corresponding melodies.

5. A melody alarm timepiece according to claim 2; wherein the resetting means includes a reset switch, a reset lever and a rotationally driven member that makes one revolution per twelve hours, the reset switch being on-off controlled through the reset lever pivotable by the rotationally driven member.

6. A melody alarm timepiece according to claim 3; wherein the time interval is twelve hours.

7. A timepiece according to claim 4; wherein the resetting means includes means for supplying the reset signal at an ascertained time of day between a first and a second on-the-hour time of day; and the alarm control circuit includes means for resetting the melody sequence to generate the first melody signal at the second on-the-hour time and to generate a respective melody of the melody sequence sequentially at each subsequent ascertained on-the-hour time.

8. A timepiece according to claim 4; wherein the resetting means includes means for supplying the reset signal at an ascertained time of day between twelve o'clock and one o'clock; and the alarm control circuit includes means for resetting the melody sequence to generate the first melody signal at an on-the-hour time of one o'clock and to generate a respective melody of the melody sequence sequentially at each subsequent on-the-hour time.

9. A timepiece, comprising: a timepiece circuit for ascertaining a time of day; detecting means for detecting an on-the-hour time corresponding to the beginning of each hour of a day and producing an on-the-hour signal in response thereto; resetting means for supplying a reset signal at at least one predetermined ascertained time of day, the resetting means including a reset switch, a reset lever and a rotationally driven member that makes one revolution per twelve hours, the reset switch being on-off controlled through the reset lever pivotable by the rotationally driven member; an alarm control circuit for electronically storing a plurality of different melodies and for generating melody signals corresponding to the respective stored melodies, sequentially from a first melody to a last melody of a melody sequence, the alarm control circuit being responsive to the on-the-hour signal for sequentially generating a different one of the melodies of the melody sequence at each on-the-hour time of the day, and the alarm control circuit being responsive to the reset signal for electronically resetting the melody sequence to the first melody so that the melody sequence is reset at the at least one predetermined ascertained time of day; and means responsive to the melody signals for playing the corresponding melodies.

* * * * *